US006453827B1

(12) United States Patent
Perazzo

(10) Patent No.: US 6,453,827 B1
(45) Date of Patent: Sep. 24, 2002

(54) REINFORCED PAPERBOARD PALLET AND RUNNER WITH PORTAL

(76) Inventor: John R. Perazzo, 3805 Sherbrooke Dr., Cincinnati, OH (US) 45241

( * ) Notice: Subject to any disclaimer, the term of this patent is extended or adjusted under 35 U.S.C. 154(b) by 156 days.

(21) Appl. No.: 09/629,530

(22) Filed: Jul. 31, 2000

Related U.S. Application Data

(63) Continuation-in-part of application No. 09/182,263, filed on Oct. 29, 1998, now Pat. No. 6,095,061.

(51) Int. Cl.[7] ..... B65D 19/00
(52) U.S. Cl. ..... 108/51.3
(58) Field of Search ..... 108/51.3, 51.11, 108/56.1, 56.3

(56) References Cited

U.S. PATENT DOCUMENTS

| | | | | |
|---|---|---|---|---|
| 1,754,784 | A | | 4/1930 | Borsodi |
| 2,503,240 | A | | 4/1950 | Cahners |
| 2,583,443 | A | | 1/1952 | Perry et al. |
| 2,904,297 | A | | 9/1959 | Hamilton |
| 2,958,494 | A | | 11/1960 | Lovegreen |
| 3,165,078 | A | | 1/1965 | White |
| 3,301,200 | A | | 1/1967 | Landsiedel |
| 3,302,593 | A | | 2/1967 | Roberts |
| 3,477,395 | A | | 11/1969 | Brown et al. |
| 3,556,886 | A | | 1/1971 | Reusser |
| 3,709,161 | A | * | 1/1973 | Kauffman |
| 3,911,182 | A | | 10/1975 | Lieberman |
| 3,911,834 | A | | 10/1975 | Quaintance |
| 3,942,654 | A | | 3/1976 | Warrick |
| 4,185,565 | A | | 1/1980 | Nymoen |
| 4,319,530 | A | | 3/1982 | Moog |
| 4,424,753 | A | | 1/1984 | Eatherton |
| 4,790,249 | A | | 12/1988 | Webb |
| 4,792,325 | A | | 12/1988 | Schmidtke |
| 4,863,024 | A | | 9/1989 | Booth ..... 108/51.3 |
| 4,955,940 | A | | 9/1990 | Welleman |
| 4,979,446 | A | | 12/1990 | Winebarger |
| 5,156,094 | A | | 10/1992 | Johansson et al. |
| 5,184,558 | A | | 2/1993 | Wozniacki |
| 5,207,631 | A | | 5/1993 | Schmidtke et al. |
| 5,218,913 | A | | 6/1993 | Winebarger et al. |
| 5,222,444 | A | | 6/1993 | Youell, Jr. et al. |
| 5,285,731 | A | | 2/1994 | McIntyre |
| 5,337,679 | A | | 8/1994 | Moorman |
| 5,357,875 | A | | 10/1994 | Winebarger et al. |
| 5,411,786 | A | | 5/1995 | Kuo |
| 5,413,662 | A | | 5/1995 | Skinner, III |

(List continued on next page.)

FOREIGN PATENT DOCUMENTS

| | | |
|---|---|---|
| FR | 2490187 | 3/1982 |
| FR | 2713201 | * 12/1993 |

*Primary Examiner*—Jose V. Chen
(74) *Attorney, Agent, or Firm*—Wood, Herron & Evans, L.L.P.

(57) ABSTRACT

A pallet includes a number of runners which may be sandwiched between upper and lower face sheets of corrugated paperboard. Each runner is comprised of multiple layers of corrugated paperboard with the flutes of the corrugations oriented vertically to provide compression strength to the runners and the associated pallet. Each runner also may include at least one reinforcing insert most preferably of hardboard to provide beam strength to the runner and a band to avoid failure without a prior indication. Moreover, each runner may include portals which permit four-way entry for the tines of a lift truck and inhibit tipping of the load off of the tines. As a result, the pallet offers significantly greater safety features, strength and resistence to crushing or compression than known paperboard pallet designs, avoids the significant ecological and economic drawbacks of wooden pallets and can be processed in a paperboard recycling station along with paperboard containers, boxes or the like.

29 Claims, 5 Drawing Sheets

U.S. PATENT DOCUMENTS 5,425,314 A 6/1995 MacFarland
5,427,019 A 6/1995 Moorman
5,443,156 A 8/1995 Hutchinson
5,461,988 A 10/1995 Cummings et al.
5,465,672 A 11/1995 Boyse et al.
RE35,131 E 12/1995 Youell, Jr. et al.
5,487,345 A 1/1996 Winebarger et al.
5,493,962 A 2/1996 McCarthy
5,520,982 A 5/1996 Grigsby et al.
5,528,994 A 6/1996 Iseli
5,531,165 A 7/1996 Taravella et al.
5,531,166 A 7/1996 Woods et al.
5,551,353 A 9/1996 Fiedler
5,568,774 A * 10/1996 Hutchison
5,584,951 A 12/1996 MacFarland
5,609,557 A 3/1997 Te
5,685,234 A 11/1997 Grigsby et al.
5,694,863 A 12/1997 Chen
6,135,030 A * 10/2000 Besaw

* cited by examiner

REINFORCED PAPERBOARD PALLET AND RUNNER WITH PORTAL

This is a continuation-in-part of U.S. application Ser. No. 09/182,263, filed Oct. 29, 1998, issued as U.S. Pat. No. 6,095,061 on Aug. 1, 2000 and hereby incorporated by reference in its entirety.

BACKGROUND OF THE INVENTION

This invention relates to a runner and pallet constructed therefrom for use in the storage and/or transport of goods and, more particularly, to a recyclable reinforced pallet and runner design.

For many years, various types of objects have been used to separate and support loads that are stored and transported generally in a stacked arrangement. The equipment that is primarily used for performing this stacking arrangement is a front end loader, lift truck or forklift truck which raises the individual loads so that they can be stacked one on top of the other or on a rack. To separate the loads from each other, off of the rack or off of the floor, a pallet or one or more spacers, risers or runners are positioned beneath the load so as to allow space for the insertion of the forks of the lift truck or the like for moving and positioning the loads for storage or transportation.

Generally, the load supporting pallets, runners and the like are used in large manufacturing and industrial plants, warehouses, wholesale and retail establishments and wherever merchandise, food products and other articles are to be lifted and carried from one location to another. Typically, these pallets or the like are mainly made from wood and consist of platforms having parallel runners longitudinally and/or transversely secured to their undersides by means of nails, staples, strappings or other suitable fasteners.

Such wooden pallets in the past have been found to be quite satisfactory in many regards for their intended use in the shifting, transportation and storage of materials and articles from one location to another. There are many advantages of wooden pallets. Wood is extremely strong on a weight basis, and machinable with standard cutting, ripping and other forming techniques. Furthermore, wood will not lose its strength in conditions of high heat, moisture and humidity.

Wood, however, has several major disadvantages. Increasing environmental awareness has become a significant factor in the packaging, transportation and shipping industries. Wood is difficult to readily recycle and, hence, many wood packaging or pallet components are finally disposed in landfills. Available landfill sites, however, are becoming full and are being closed. If landfill disposal is even available, significant fees for dumping such bulky materials are becoming prohibitive. As a result, many customers of manufacturers of heavy durable goods are prohibiting the use of wood pallets.

Wood pallets also are very cumbersome, are unwieldly and take up unnecessary and valuable space in conveyances, warehouses and other places of storage. As transportation costs have risen, the concept of moving wood pallets back and forth for reuse, which has always been a burden on the industry, has become economically prohibitive.

In international shipment of goods, wooden pallets present additional environmental problems because they tend to serve as hosts for germs and bugs. As a result, pallets are often quarantined or burned upon arrival in another country according to governmental regulations or general precautionary practices to avoid the spread of undesirable insects, bugs or germs. This has proven to be very costly and a significant economic drawback to wood pallets.

The *Wall Street Journal* recently recognized the many significant problems associated with wooden pallets in an article entitled "*As Old Pallets Pile Up, Critics Hammer Them as a New EcoMenace*" and published Apr. 1, 1998. According to that article, there are purportedly 1.5 billion pallets in the U.S. and about 40 percent of domestic hardwood lumber goes into pallets. However, a third of U.S. landfills won't take pallets. Purportedly, more than 1 million forest acres are chopped every year for pallets, skids or the like. Cost for the wood to make the pallets is increasing and the available supply of wood is decreasing.

Loads on a pallet are often transported within a warehouse or other facility on a conveyor or rollers. Commonly, wooden pallets splinter and jam the rollers of the conveyor and thereby damage the conveyor and interrupt the movement of the goods in the warehouse. The use of wood pallets on such conveyors has become so problematic that many facilities prohibit their use on roller conveyors and mandate that the load be transferred to another type of pallet for use on the conveyor or the conveyor not be used at all. Quite evidently, this is very inefficient and time consuming and a significant disadvantage for the continued use of wood pallets.

Wood pallets offer excellent strength and durability, but even these desirable qualitites have proven to be, at best, questionable justification for the continued use of wooden pallets.

To avoid some of these objections to the use of wood pallets, alternative pallet designs have been made from materials such as corrugated paperboard, scrapped paperboard, plastics, aluminum and other materials. While solving certain problems associated with wood pallets, use of alternative materials to date has only provided additional problems. Known corrugated paperboard pallets provide lightweight, inexpensive alternatives to conventional wooden pallets for some applications, but their strength and rigidity under static and dynamic loading is insufficient to permit wide spread general usage for all types and distribution of goods. Such pallets often have excessive deflection and lack beam strength, which causes their sagging under loads, thereby making the handling, stacking and racking of the pallets impractical and even dangerous. Commonly, loads are mounted upon spaced beams of a rack and the weight of the load is concentrated on the pallet at the beam. Many so called improved pallet designs do not offer the strength necessary to withstand buckling, crushing or compression when placed upon a rack under a load. A suitable pallet for use on a rack must provide minimal compression at the beams of the rack and zero to minimal deflection between the beams of the rack. Known paperboard pallets do not meet these compression and beam strength criteria for rackability.

Strength requirements for known paperboard pallets and runners have generally been inadequate. Moreover, when the pallet or runner approaches and exceeds the failure criteria, no warning or indication of the impending failure is typically evident. In other words, as a load is transported, moved or stored on a pallet or runner and exceeds the strength limit for the pallet or runner, occurs without a warning or opportunity to replace the various components.

Additionally, known paperboard pallet designs typically become compressed, crushed, milled off or damaged when used under a load being transported on a roller conveyor. Moreover, corrugated paperboard, for instance, may lose up to 50 percent of its stacking strength during conditions of high humidity and moisture when the paperboard absorbs atmospheric moisture and the like.

As loads are transported on the tines of a forklift or lift truck, the ability to insert the tines under the load from any direction is a significant convenience for the forklift operator. A so called four-way entry to the pallet by the tines of the lift truck or the like is common in the Grocery Manufacturers Association (GMA) type of pallets. To provide four-way entry, some runners include notches which are open to the bottom face of the runner to provide entry of the tines on the lift truck into the runner for lifting the pallet as is shown in the present inventor's prior application, Ser. No. 09/182,263 which matured into U.S. Pat. No. 6,095,061.

However, if the tines of the forklift or lift truck are not properly positioned in the notches to lift and transport the load or the load is unbalanced, the load could potentially tilt and fall off of the tines. As such, many manufacturers and/or operators often add stringers along the bottom open face of the notches in an effort to stabilize such loads supported on the tines and inhibit the load from tipping or falling off. Nevertheless, stringers of this type typically cannot be added to wood runners or are often ineffective, particularly for heavily loads that could be easily damaged, torn or dislodged during use thereby becoming ineffective for their intended purpose.

Thus, there is an increasing need for pallets which are economically and ecologically feasible. However, an acceptable pallet must possess the strength to support their intended loads particularly on a rack or conveyor and must be sufficiently durable to withstand repeated use including being lifted with a lift truck or the like while loaded. Further, desirably the pallet must resist deterioration by the elements of the weather. Moreover, an acceptable pallet must be competitively priced in the marketplace.

Therefore, it is apparent that there is a need in the industry for a pallet and/or runner which satisfies these and other criteria and overcomes the associated disadvantages and shortcomings of known pallet and runner designs.

SUMMARY OF THE INVENTION

The improved runner and pallet constructed therewith overcomes the above-described disadvantages of wood pallets and pallets or runners made from alternative materials known in the shipping, packaging and container industries. Advantageously, the pallet and runner design according to this invention is economically feasible while being lightweight and providing significant strength and increased load bearing capability and resistance to compression or crushing so that the pallet/runner can support a load on a rack or conveyor. Importantly, the pallet/runner design of this invention, while providing these significant advantages over know pallet/runner designs, is also entirely processible in a paperboard recycling system or the like for convenient, economical and ecological disposal.

Specifically, a pallet according to a presently preferred form of this invention includes at least two spaced generally parallel runners and each of the runners is constructed of a number of layers of double wall or double face corrugated paperboard glued together in face to face orientation with the flutes of the corrugations being generally aligned in a generally vertical direction. Each of the runners also includes at least one generally vertically oriented reinforcing insert positioned interiorly of the runner between adjacent layers of the corrugated paperboard.

Furthermore, in still other presently preferred embodiments, the runner may include a band with a number of nylon, polyester or other material strands situated between the adjacent layers of the corrugated paperboard or incorporated into the various layers of the corrugated paperboard during manufacturing. The band may be used in addition to or as an alternative to the reinforcing inserts. The band is primarily added to the runner to minimize catastrophic rupture, tearing or failure of the paperboard runner as it approaches its maximum load limit. For example, runners which include such a band would begin to sag as they approach they load limit while runners without such a band would fail without warning or notice or opportunity for replacement of the pallet or runner.

Each of the runners preferably includes at least two spaced notches or portals with the respective notches or portals being aligned with one another so that the tines of a lift truck or the like can be inserted therein in a direction generally perpendicular to the runners for lifting the pallet and the load supported thereon. The runners are spaced and generally parallel so that the tines of the lift truck can alternatively be inserted generally parallel to the runners for lifting the pallet and the load and thereby providing what is known in the industry as four-way entry into the runner. The notches in the runner are generally open to the bottom surface of the runner; whereas, in an alternative embodiment, the portals are formed as throughholes in the runners and generally perpendicular to the adjacent layers of paperboard. The portals provide a safety feature in that the pallet is inhibited from tipping off of a forklift while picking up pallets with the tines inserted in the portals. Moreover, the portal configuration provides increased strength relative to the open bottom notches disclosed in U.S. Pat. No. 6,095,061.

A pallet constructed with the above-described runners may also include a generally planar upper deck sheet joined to an upper surface of each of the runners and a generally planar lower deck sheet generally parallel to the upper deck sheet and joined to a lower surface of the runners. Alternatively, the upper deck sheet may include a plurality of sidewalls each projecting generally upwardly from a perimeter thereof to define a tray atop the runners to contain the load on the pallet.

The runners may be used separately from the pallet construction. As such, a deposit of adhesive in a presently preferred form is applied to the upper surface of the runner to secure the runner, at least temporarily, to the lower surface of a load to thereby enable the load to be lifted by a lift truck and stored on a rack or the like.

A significant advantage of the pallet/runner design according to this invention is that all of the components of the pallet/runner are entirely processible in a paperboard recycling system while still providing strength and stability for use under a load on a rack or conveyor. In prior pallet designs, wood components used either exclusively or in combination with paperboard or other materials prevented the pallet/runner from being processed in a paperboard recycling system. When a shipment of goods or the like is received by a customer, the paperboard boxes or cartons containing those goods are commonly disposed of in a paperboard recycling station. However, the associated pallet/runner was shipped to a landfill or the wood components were manually separated from the other materials. Advantageously, the pallet/runner design of this invention can be deposited into the recycling system along with the cartons or boxes to provide an economical and ecological disposal of the pallet/runner without the labor intensive task of separating the various materials.

Commonly, wood pallets must be quarantined upon arriving at international shipping destinations; whereas, primarily paperboard pallets such as the present invention are not required to be quarantined to avoid the spread of regional diseases, harmful insects or the like.

Various commercial consumers have specifically identified a need for a pallet which can be: 1) placed in a corrugated waste bailer or recycling station at each store so that the components thereof can be processed and sold for recycling along with the used paperboard boxes and other containers commonly processed therein; 2) strong enough to be stored in racks in the same manner as wooden pallets; and 3) has the same four-way entry feature as a wooden pallet. Importantly, these objectives must be obtained in an economical manner to offer a commercially viable alternative to wood pallets. The present invention satisfies these and other requirements.

Wood pallets are typically competitively priced at about $7.50 per pallet; whereas, estimates for the pallet of this invention are very economical at about $6.00 to $6.50 per pallet. Moreover, the pallet/runner according to this invention is very lightweight, on the order of about 17 to 18 pounds per pallet thereby providing for easy maneuvering and handling thereof.

While still being lightweight, the pallet/runner, due in large part to the reinforcing insert and/or band and the flute orientation of the corrugated paperboard, provides significant strength and load bearing capability while resisting compression or crushing. While the chipboard, fiberboard, linerboard, Kraft and paperboard are materials of the reinforcing insert that are common to the shipping, packaging and container industry, particleboard and hardboard provide significant strength to the runner and are materials not typically known in those industries. Particleboard and hardboard are commonly used in the building or construction industry. Furthermore, the hardboard is the most preferred reinforcing insert material because it is primarily a wood fiber based component, it can be die cut, laminated, sawed or otherwise shaped as is required, although such techniques are not commonly employed in the building industry for hardboard. Additionally, hardboard and the other materials for the reinforcing insert are each resistant to the absorption of water and moisture or the like and, therefore, the strength of the runner/pallet does not significantly degrade when exposed to these conditions unlike known primarily paperboard pallet or runner designs.

The corrugated paperboard of the runner offers compression resistance and alignment stability such that the runner does not easily twist, bend, buckle or turn when loaded with a non-vertically aligned load. However, the corrugated paperboard offers little or no beam strength to the runner design. As such, known corrugated paperboard runners deflect dramatically and/or fail when placed on the beams of a rack under load. The reinforcing insert of hardboard or the like provides beam strength and resistance to compression for the pallet/runner but offers very little alignment stability to the pallet/runner. Therefore, this invention advantageously combines these two components into a pallet/runner design which offers alignment stability, beam strength and compression resistance.

As a result, the pallet/runner of this invention overcomes the significant disadvantages of wood pallets while offering an ecological and economical alternative that provides considerable strength and weight bearing capability so that loads can be easily placed on a rack or the like without compression or crushing of the pallet/runner. The entire pallet/runner can be processed in a paperboard recycling station for ecological and convenient disposal thereof and offers a safer alternative to known pallet/runner designs by avoiding catastrophic failures without warning and minimizing the opportunity for the runner supported load to tip off of the tines of a lift truck.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
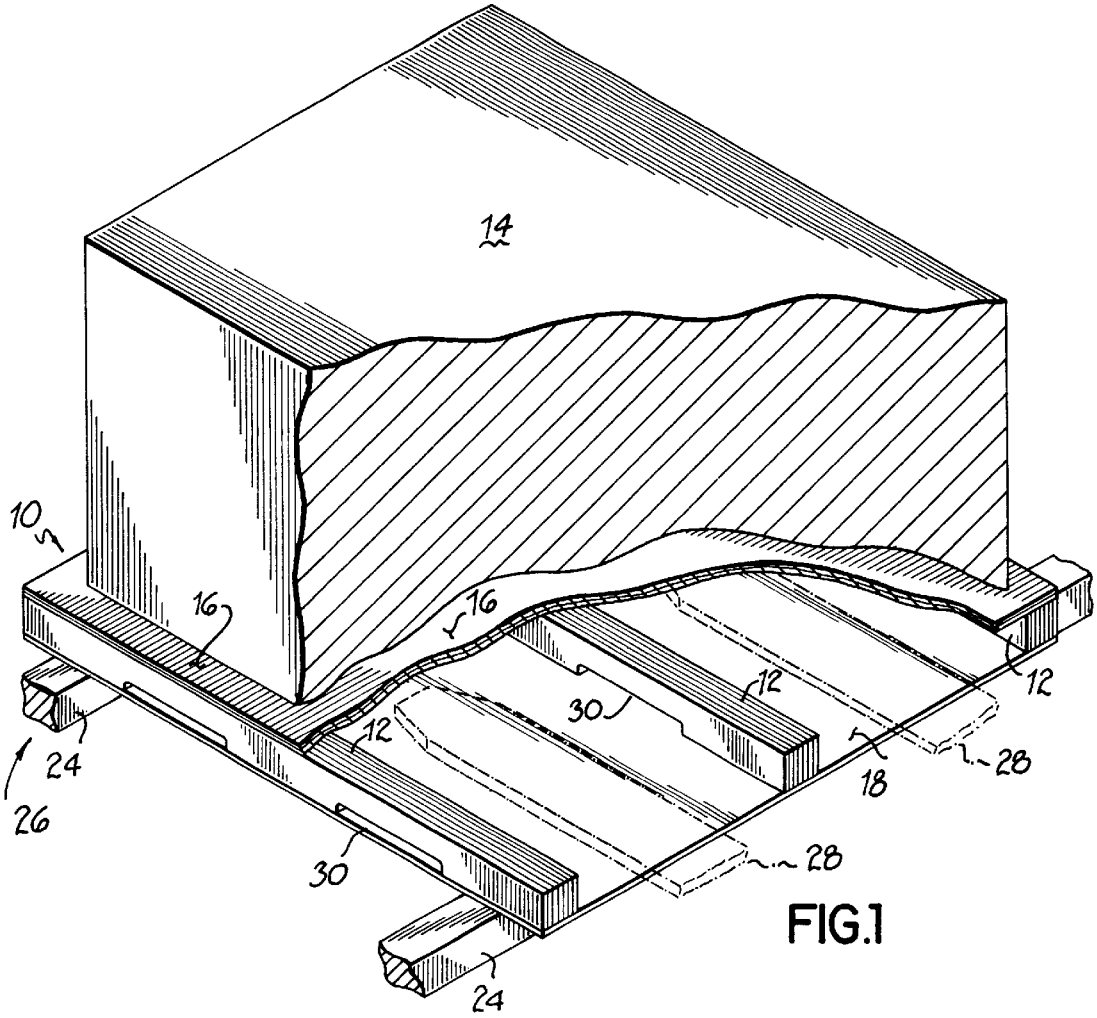
FIG. 1 is a perspective view of a presently preferred embodiment of a pallet supporting a load on a rack with a portion of the load and an upper deck sheet of the pallet being broken away to expose the runners of the pallet.
Figure 1A:
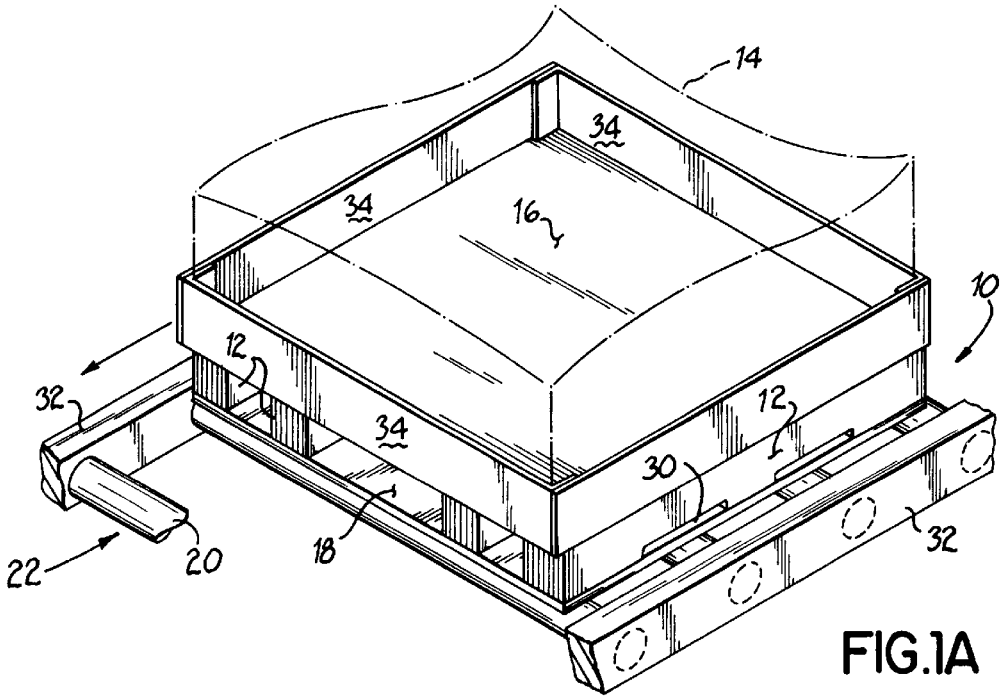
FIGS. 1A and 1B are each perspective views of alternative embodiments of the pallet according to this invention with a tray containing a load shown in phantom while the pallet and load are being transported on a conveyor.
Figure 1B:
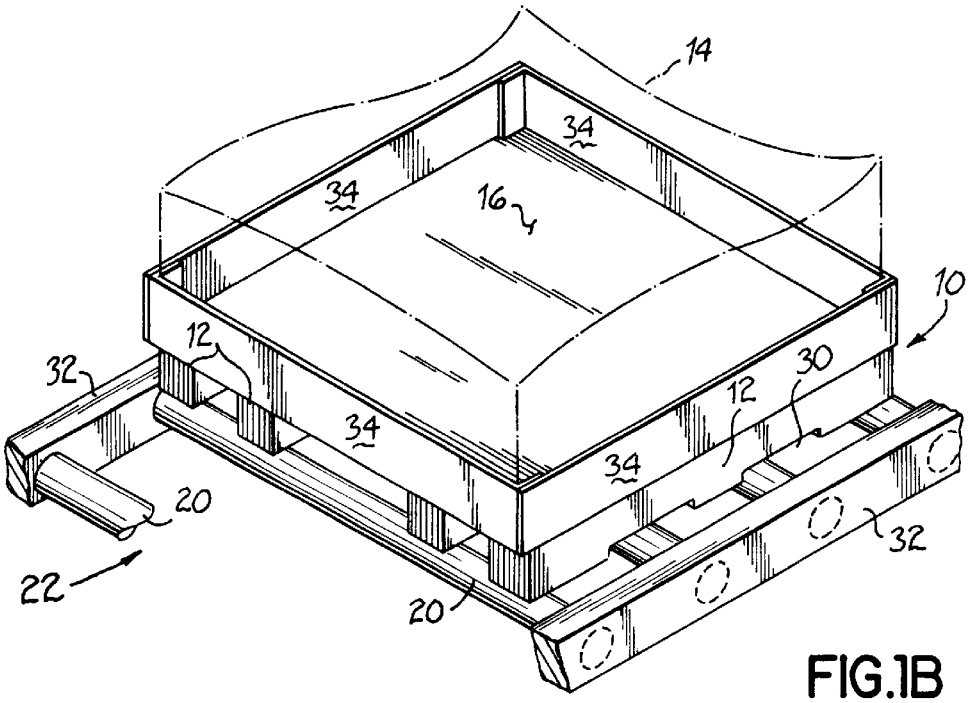

Referring to FIG. 1, a presently preferred embodiment of a pallet 10 according to this invention is shown. The pallet 10 includes a plurality, three of which are shown in FIG. 1, of generally parallel runners 12. It will be readily understood that the pallet 10 supports a load 14 and may include two, four (FIG. 1A) or another number of runners 12 within the scope of this invention. The runners 12 are sandwiched between an upper deck sheet 16 adhered, preferably by adhesive or the like, to an upper surface of each of the runners 12 and a lower deck sheet 18, likewise adhered by adhesive or the like, to a lower surface of the runners 12. The lower deck 18 sheet contributes to the structural integrity of the pallet 10 when rolling down the rollers 20 of a conveyor 22, as shown in FIG. 1A, without crushing or collapsing the pallet 10 under the load 14. The lower deck sheet 18 as such aids in the alignment of the runners 12 for proper vertical orientation while used on the conveyor 22. However, in certain applications, it would be understood that the lower deck sheet 18 and/or the upper deck sheet 16 may be eliminated as shown in FIG. 1B. The pallet 10 supports the load 14 during transportation of the load 14 or storage thereof, for example, on the spaced beams 24 of a rack 26 such as that shown in FIG. 1. Typically, the beams 24 are spaced about 36 inches apart and in some applications are 42 inches apart and extend generally parallel to one another and perpendicular to the runners 12 in the pallet 10.

The runners 12 are spaced and generally parallel to one another so that tines 28 of a lift truck (not shown) or the like may be inserted between the runners 12 below the upper deck sheet 16 and above the lower deck sheet 18 for lifting, maneuvering and/or transporting the pallet 10 and load 14. Each of the runners 12 further includes a pair of spaced notches 30 which are generally aligned with the notches 30 in the other runners 12 of the pallet 10 and extend the width of the respective runner 12. The notches 30, according to a presently preferred form of the invention, are open to the bottom surface of the runner 12 and provide for entry of the tines 28 of the lift truck into the runner 12 for lifting the pallet 10 and the load 14 for maneuvering and/or transporting the pallet 10 and load 14 combination. As a result, the spaced runners 12 and notches 30 thereof provide for four-way entry to the pallet 10 by the tines 28 of the lift truck or the like as is common in the popular Grocery Manufacturers Association (GMA) type pallets.

Figure 5A:
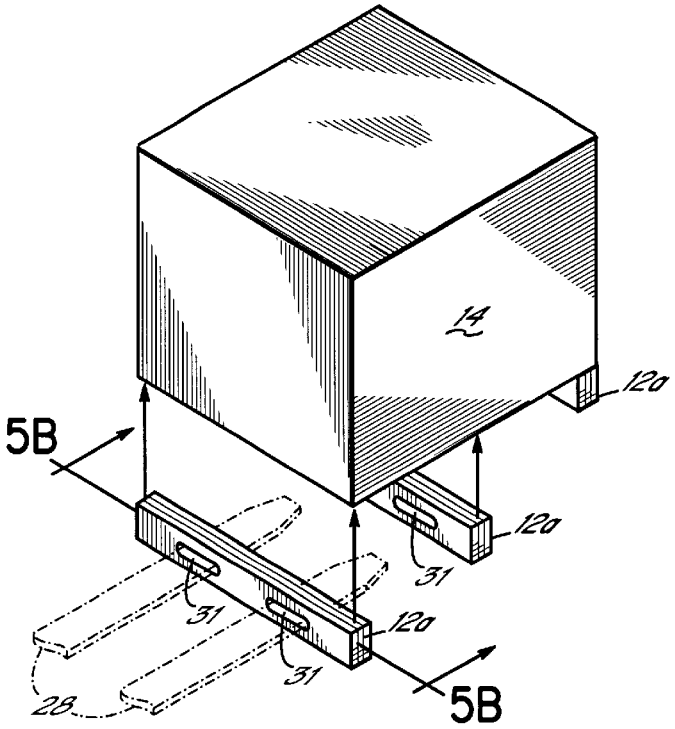
FIG. 5A is a perspective view similar to FIG. 3 with a further alternative embodiment of a runner according to this invention.
Figure 5B:
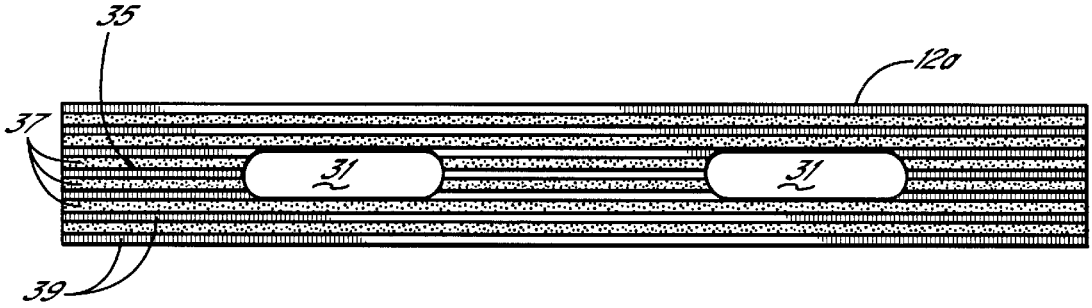
FIG. 5B is a cross-sectional view taken along line 5B—5B of FIG. 5A of that runner embodiment.

In an alternative runner embodiment, as shown in FIGS. 5A and 5B, each runner 12*a* includes at least two spaced portals 31 which extend entirely through the runner 12*a* for the insertion of the tines 28 of a forklift, lift truck or the like. The portals 31 are oriented generally perpendicular to the longitudinal axis of each runner 12*a* and are essentially located between top and bottom surfaces of the runner 12*a*. Advantageously, the configuration of the runner 12*a*, as shown in FIGS. 5A and 5B, provides a safety feature in that the pallet 10, load 14 and/or runner 12*a* cannot tip off of the tines 28 of a forklift or lift truck which is a common problem when picking up loads with open bottom notches as shown in prior pallet and runner designs. The portion of the runner 12*a* beneath the portal 31 provides a more secure and stable runner and pallet design so that an unevenly distributed load on the tines 28 of the forklift will not tip or fall off of the tines 28 as is possible with the open bottom notch pallet design. Moreover, when a forklift or lift truck suddenly stops or accelerates, the load 14 is stabilized on the tines 28 as a result of the tines 28 being inserted into the portals 31. Moreover, runners constructed with the portals 31 have been tested to be about 7 percent stronger than those with open bottom notches. The lower portion of the runner below the portal 31 was completely in tact even after a failure was sensed in the testing procedure. As such, when in use, the pallet 10 with such runner 12*a* would remain functional and not have fallen through the rack which provides a significant safety feature since one concern with known paperboard pallets is a lack of historical safety data.

Preferably, the portal 31 would be laser cut or stamped out of the individual layers of paperboard which would then be sandwiched together to construct the runner 12*a*. Portals 31 of this type are commonly not manufactured in wooden runners or pallets because of the difficulty in drilling or sawing such throughholes or portals in the wood without damaging the runner and resulting in excessive scrap.

It should be readily appreciated that the runner 12*a* can be utilized with a pallet of any desired design or configuration as well as upper and/or lower deck sheets 16, 18 or in combination with other such runners 12*a* and applied directly to the load 14 as shown in FIG. 5A.

As shown in FIGS. 1A and 1B, the pallet 10 is also useful for the movement of the load 14 on the conveyor 22 or the like. The pallet 10 may support the load 14 on rollers 20 of the conveyor 22 mounted for rotation between spaced generally parallel side rails 32 of the conveyor 22. Preferably the runners 12 of the pallet 10 are oriented generally perpendicular to the rollers 20 of the conveyor 20. The pallet 10 is advantageously useful for transferring the load 14 on the conveyor 22 with the lower deck sheet 18 as shown in FIG. 1A or without the lower deck sheet as shown in FIG. 1B. Typically, the lower deck sheet 18 is only included when the pallet 10 is to be used on the roller conveyor 22. Pallets 10 manufactured according to this invention without the lower deck sheet 18 can be nested with one another for space efficient, compact shipment of the pallets 10 when not in use.

An alternative embodiment of the upper deck 16 sheet as shown in FIG. 1A, may include a plurality of upwardly standing sidewalls 34 which are folded from the material of the upper deck sheet 16 to extend around the perimeter thereof. The upper deck sheet 16 and the upwardly standing sidewalls 34, in combination, define a tray which is particularly useful in containing a non-unitized load or the like.

In a presently preferred form, each runner 12 is approximately 48 inches in length, 3.5 inches in width and 3.5 inches in height. Each notch 30 is spaced approximately ten inches from the nearest end of the runner 12, and is approximately 9.75 inches in length at the lower face of the runner 12, has a height of approximately one inch and tapers upwardly to a length of about 8.5 inches at an upper surface thereof.

In a presently preferred form, each runner 12*a* is approximately 48 inches in length, 3.5 inches in width and 3.5 inches in height. Each portal 31 is spaced approximately 8 inches from the nearest end of the runner 12*a* and is approximately 9 inches in length and spaced approximately ⅞ inch from the top and bottom surfaces of the runner 12*a*. Each portal 31 has a height of approximately 1.75 inches. Preferably, the upper and lower deck sheets 16, 18 each measure approximately 40 inches by 48 inches and the upstanding sidewalls 34 of the tray configuration of the upper deck sheet 16 shown in FIGS. 1A and 1B are approximately 4 inches in height. The flutes of the upper and lower deck sheets 16, 18 are preferably oriented perpendicularly to the runners 12 or 12*a*.

Figure 2:
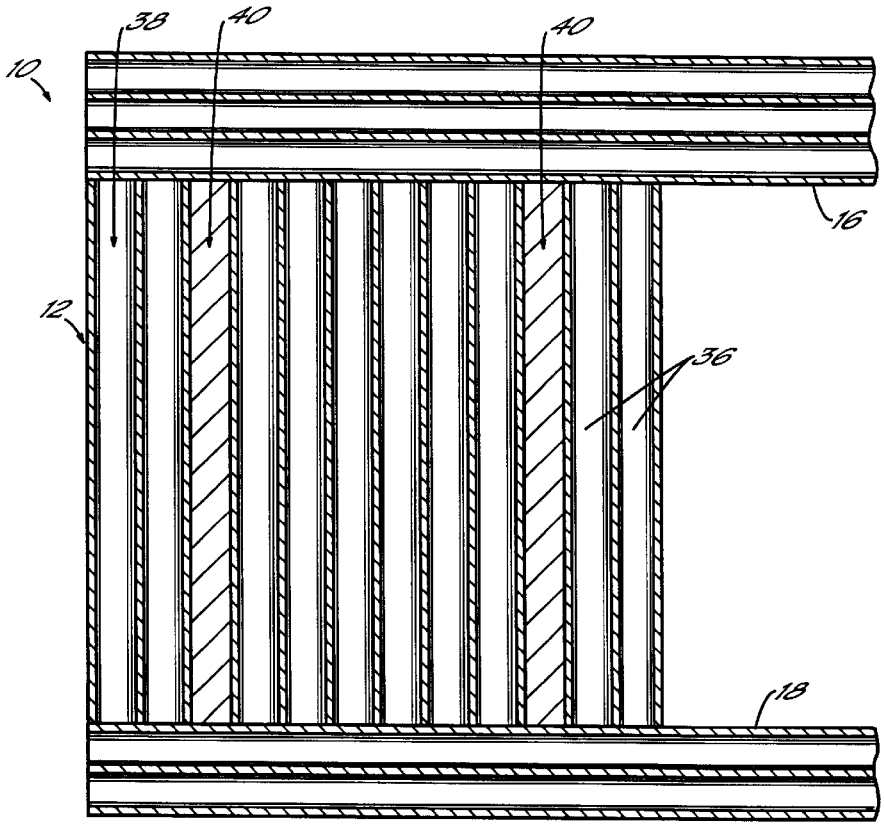
FIGS. 2 and 2A are cross-sectional enlarged views of a portion of a pallet including alternative presently preferred embodiments of a runner according to this invention.
Figure 2A:
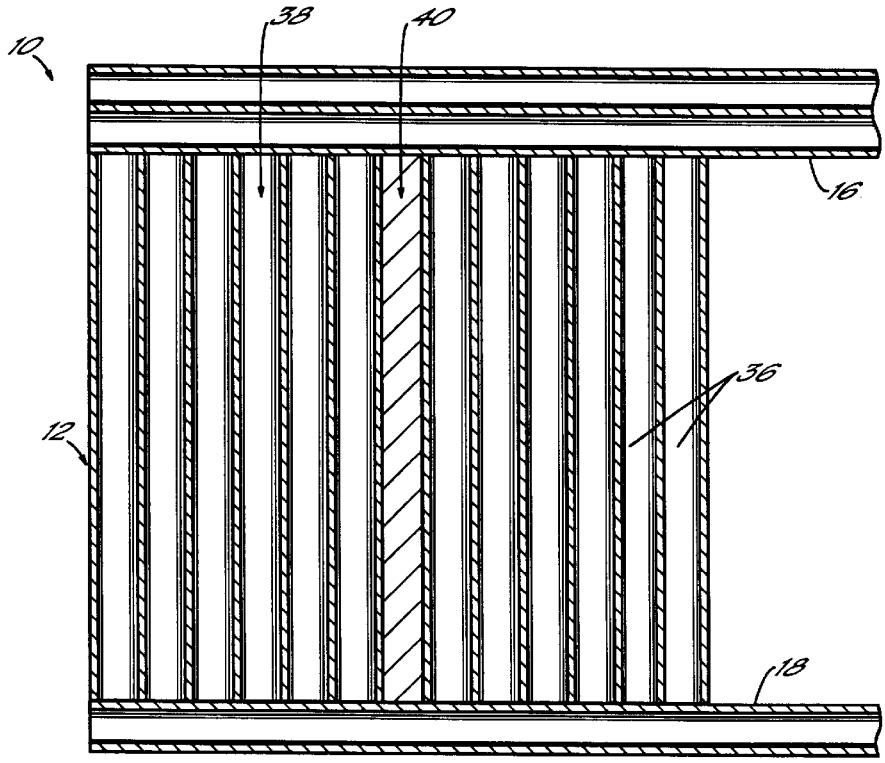

Referring to FIGS. 2 and 2A, cross-sectional views of alternative embodiments of the pallet 10 and one of the runners 12 thereof are shown in cross section. Specifically, in FIG. 2A, the runner 12 is preferably constructed of a plurality of sheets of paperboard 36, each of which are corrugated and built up and adhered in face to face relation by an adhesive such as polyvinyl alcohol (PVA) or another suitable adhesive commonly known in the industry. Each layer of corrugated paperboard 36 of the runner 12 of FIG. 2A preferably is 125# paperboard with type A or type C flutes 38, although any flute configuration or paperboard can be employed with this invention. The flutes 38 in the runners 12 extend generally vertically in single wall or double face corrugated paperboard 38. Preferably, the runner 12 of FIG. 2A includes four plies of double wall corrugated paperboard 36 on either side of a center reinforcing insert 40 which is most preferably a sheet of one-quarter inch thick piece of hardboard. Advantageously, the reinforcing insert 40 is sandwiched interiorly of the runner 12 or 12*a* and is oriented generally vertically or perpendicular to the deck sheets 16, 18 to provide beam strength to the runner 12. Preferably, the reinforcing insert 40 is not located on the exterior faces of the runner 12 or 12*a* to avoid lamination issues or other potentially detrimental effects.

Additionally, locating the reinforcing insert 40 on the interior of the runner 12 or 12*a* allows the corrugated paperboard 36 layers to assist in maintaining the reinforcing insert 40 vertical when the pallet or runner is loaded. The corrugated paperboard 36 and vertically aligned flutes 38 advantageously provide compression strength to the runner 12, 12*a* and associated pallet 10 as well as the alignment of the runner 12, 12*a*; however, the corrugated paperboard offers little or no beam strength which is provided by the reinforcing insert 40.

Alternatively, locating the reinforcing inserts 40 close to if not on the interior face of the outermost runners 12, 12*a* of a pallet 10 as shown in FIG. 2 does offer durability advantages.

Specifically, operators of lift trucks commonly do not insert the forks of the lift truck parallel to the runners 12, 12*a* of the pallet 10 either unintentionally or intentionally to rotate the load 14 and pallet 10 or shift/slide the pallet 10 on the ground without completely lifting it. Therefore, the leading edges of the forks 28 contact the inner faces of the runners 12, 12*a* which would puncture and/or damage many known paperboard runner designs. Placement of the reinforcing insert 40 of this invention at or near the inner face of the runner 12, 12*a* would inhibit and/or prevent the fork 28 from puncturing the runner 12 in this scenario due to the high impact strength and hardness properties of the hardboard and other reinforcing insert 40 materials.

According to the embodiments shown in FIGS. 2A and 2, the lower deck sheets 18 are single wall 200#B corrugated paperboard and double wall 200# paperboard of preferably type A or C flutes, respectively. The upper deck sheets 16 of FIGS. 2 and 2A are preferably triple wall 1100# corrugated paperboard and double wall corrugated paperboard with type A or C flutes, respectively. The flutes of the deck sheets 16, 18 are oriented generally perpendicular to the longitudinal axis of the runners 12. In certain applications, a layer of hardboard may be used in place of or in addition to the corrugated paperboard of the upper and/or lower deck sheets 16, 18.

The reinforcing insert 40 is most preferably a rigid or non-flexible member such as hardboard and provides beam strength and resistance to compression for the runner, but offers little or no alignment stability. Preferably, the reinforcing insert is recyclable and provides added strength such as a piece of chipboard, fiberboard, linerboard, Kraft or paperboard. More preferably, the reinforcing insert is a piece of particleboard and, most preferably, a piece of hardboard which provides increased load bearing capability to the runner and associated pallet, increased resistance to compression and is entirely recyclable. However, hardboard is too costly and heavy to be economically and practically used as the only component of the runner/pallet design; therefore, it is advantageously used in combination with paperboard in this invention.

The term "chipboard" is commonly understood in the shipping, packaging or container industry to be a paperboard product generally made from recycled paper stock. "Paperboard" is defined as one of two major product categories in the paper industry and includes materials made on board machines of cellulosic fibers primarily wood, pulp and recycled paper stock. The major types of paperboard are containerboard and boxboard. The other major product group of the paper industry is paper. Another commonly accounted term in that industry is "fiberboard" which is a general term describing combined paperboard typically used for manufacturing containers and may be corrugated or solid. Solid fiberboard is generally considered a solid board made by laminating or pasting two or more plies of container board together.

"Linerboard" is paperboard used commonly for the flat outer facings of combined corrugated fiberboard, and the outer plies of fiberboard. "Kraft" designates pulp, paper, or paperboard produced from wood fibers by the sulfate process. Kraft cylinder and Kraft Fourdrinier are also types of Kraft, all of which are collectively referred to as "Kraft".

Hardboard and particleboard are materials commonly used in the building industry. Hardboard is made from wood fibers. In contrast, "particleboard", another building industry material, is made from wood chips and other particles which are not refined into a distinct fiber. The production of particleboard is a "dry" process whereas hardboard on the other hand is produced by both/either a wet and/or dry process.

The term hardboard is not generally known in the container or shipping industry and is typically used as a building material. "Hardboard" is a generic term for panel manufactured primarily from interfelted ligno-cellulose fibers consolidated under heat and pressure in a hot press to a density of at least about 31 pounds per cubic foot. The inter-fiber bond is primarily achieved through the action of the lignin mechanism. Other materials may be added during manufacture to improve certain properties such as stiffness, hardness, finishing properties, resistance to abrasion and moisture, as well as to increase strength, durability and utility. Hardboard is made almost entirely from wood such as wood chips, board trimmings or other scrap which was once waste from the lumber industry and is now routinely saved for processing into hardboard. Generally, hardboard is made from wood chips converted to fibers which are permanently bonded together under heat and pressure into a panel. The binding agent for the hardboard determines the ease with which the product can be recycled in standard paperboard recycling processes. Hardboard is available from Temple-Inland Forest Products Corp.'s Building Products Division of Dibol, Texas and Georgia-Pacific manufactures and sells a hardboard product code No. 8199911812 that is particularly adapted for use with this invention because of its recycling properties.

Corrugated paperboard is generally well known within the packaging industry; whereas, hardboard is common to the construction or building materials industry and applicant has advantageously combined materials from two different industries to solve problems heretofore known with pallets and runners.

Even though hardboard is comprised primarily of wood fibers, it is readily processible in a paperboard recycling station along with the corrugated paperboard and other components of the pallet and runner. Moreover, hardboard does not readily absorb water or moisture such that if the pallet 10 or runner 12, 12*a* constructed according to this invention is exposed to excessive moisture, the pallet/runner will not fail even though the corrugated paperboard components thereof may absorb the water. Therefore, the strength of the pallet 10 or runner 12, 12*a* will be maintained until such time as the paperboard components have dried.

An alternative embodiment of the runner 12, 12*a* is shown in FIG. 2 in which two reinforcing inserts 40, 40, most preferably of hardboard, are positioned proximate the exterior faces of the runner 12, 12*a* with two layers of corrugated paperboard 36 on the exterior most sides of the hardboard and six layers of corrugated paperboard interposed between the reinforcing inserts 40, 40.

The pallet 10 and associated runner 12 according to this invention have each been tested to far exceed expected loading requirements and performance of known non-wooden pallet designs. Specifically, single runners 12 according to the embodiment shown in FIG. 2, both with and without the notches 30, were tested according to ASTM Designation D642-76 compression test entitled "Standard Method of Compression Tests for Shipping Containers". Each such runner 12 withstood 30,000 pounds, the maximum load possible on the testing machine, without failure or compression. Because 30,000 pounds was the limit for the testing machine, the runner 12 is capable of withstanding an even greater load under this test procedure.

The pallet 10 according to this invention as shown in FIG. 2 with three equally spaced runners 12 and without a lower deck sheet 18 was also tested. The pallet 10 was positioned to span the beams of a rack spaced 42 inches apart and the load was positioned on a center 12 inch section of the pallet 10 extending the entire 40 inch width of the pallet parallel to the beams and perpendicular to the runners 12 of the pallet 10. The pallet 10 of this design in which the runners 12 did not include the notches 30 was tested in such a manner to withstand 2206 pounds of force with only 1.02 inches of deflection at the mid-point between the beams of the rack. The pallet 10 of this design in which the runners 12 included the notches 30 was tested to withstand 1055 pounds of force with only 0.55 inches of deflection. An additional test of the pallet 10 with four such runners 12 including notches 30 was tested to withstand 1416 pounds of force with only 0.65 inches of deflection. The above-described testing design is considered to be a significantly more severe and demanding test than that typically used for wood pallets; namely, ASTM Designation D1185-94 test entitled "Standard Test Methods for Pallets and Related Structures." This ASTM test method applies the load to the entire length of the pallet spanning the spaced beams of the rack in contrast to the center 12 inch section as in the test performed on the pallet of this invention. This pallet was successfully tested in racks up to 4000 pounds when spanning the entire runner length.

In comparison, a standard corrugated paperboard runner without the reinforcing inserts 40 was tested in a similar manner and failed under the pre-load condition even before the testing machine could register a testing load.

This and other test data on the pallet/runner design of this invention provide ample evidence that the combination of the reinforcing insert 40 and the paperboard layers 36 offer both beam strength and compression resistance for a pallet which is rackable under loads far exceeding expected use conditions. Moreover, the pallet/runner offers these significant advantages in addition to being recyclable and relatively lightweight.

The testing of the pallet/runner of this invention also revealed another benefit of this design. When the runner 12 is loaded to its limit of beam strength when spanning the beams of a rack, the runner produces an audible "pop" or similar sound unlike known non-wood runner designs. The audible sound is a safety feature to this design because even though it has greatly increased beam strength, the "pop" will alert a worker that the runner/pallet is loaded at or above its maximum level and corrective measures are required such as disposal, recycling and replacement of the runner/pallet or removal of some/all of the load is required.

Another feature of an alternative embodiment of the runner 12*a* and pallet 10 constructed with such a runner 12*a* according to this invention is shown in FIG. 5B. The runner 12*a* includes a band 35 which may be sandwiched between the individual layers of paperboard 36 in the runner 12*a* and/or the reinforcing insert 40. Alternatively, the band 35 may be incorporated into the paperboard configuration between the flutes and the facing sheets of the paperboard during manufacture thereof. In one presently preferred embodiment, the band 35 includes a number of strands 37 of nylon or polyester reinforced material which may or may not include a hot melt adhesive binder 39. Preferably, the band 35 includes a number of strands 37 of nylon, polyester or other similar material at one or more locations in each runner 12*a*. In one presently preferred embodiment, the band 35 may be Marotapes™ which is commercially available from Marotech, Inc. in Quebec, Canada or Sesame Tape™ which is likewise commercially available.

Runners 12*a* which include the band may or may not be significantly stronger than runners 12 without the band of a similar construction; however, runners 12*a* with such a band deflect, sag or bow before failure and the paperboard did not rupture or tear upon failure. As such, the runners 12*a* with the band 35, which are utilized in a rack configuration as shown in FIG. 1, would begin to sag or deflect thereby indicating to a user that the runner and/or pallet was approaching its ultimate limit and about to fail and thus provide an indication of the need for corrective measure and/or replacement. Without the band 35, the runners would rupture, tear and/or fail and fall through a racking system thereby potentially damaging the load and other items therebelow.

As used herein, the term "band" includes products such as those described above as well as other woven or nonwoven netting, webbing, mesh, layers, binders or the like which may be inserted or incorporated between the adjacent layers of paperboard or incorporated into one or more individual layers of paperboard as described. Such reinforcing bands may or may not include a hot melt or other adhesive component according to this invention. The band is typically flexible or non-rigid according to certain embodiments and adds tensile strength to the runner to allow it to sag or bend prior to failure without rupturing, tearing or ripping the paperboard components and, as such, provides an early warning indication of an impending failure of the runner and/or pallet.

Figure 3:
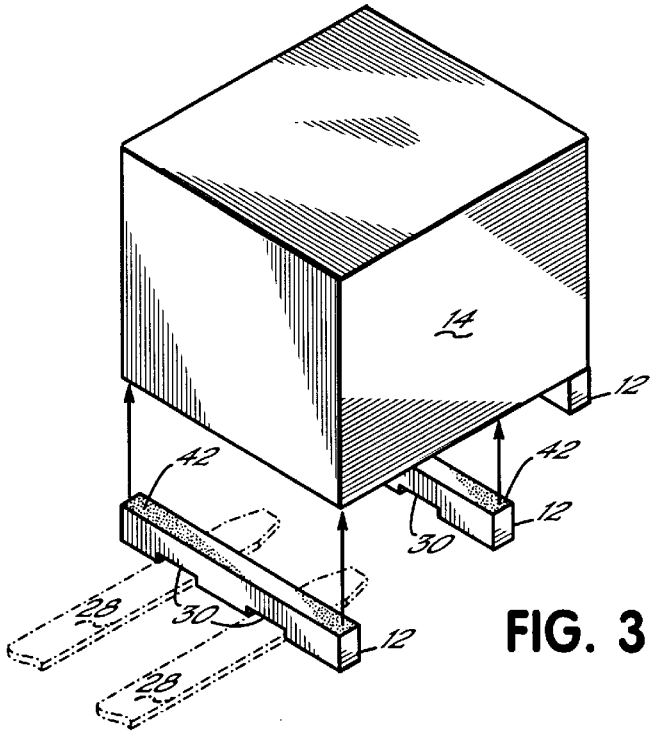
FIG. 3 is a perspective view of individual runners being adhered to a bottom surface of a load.

Referring to FIGS. 3 and 5A, the runner 12, 12*a* according to this invention may be used in combination with other runners 12, 12*a* and applied directly to the bottom of the load 14. An adhesive 42 (FIG. 3) is deposited onto the upper surface of the runner 12, 12*a* which is preferably non-drying, non-permanent so that the runner 12, 12*a* may be selectively applied and removed from the lower surface of the load 14 as required. Preferably, the adhesive is deposited onto the open flutes 38 of the paperboard 36 and cool air is blown upwardly from the runner 12, 12*a* through the flutes 38 to cool the adhesive 42. Preferably, such an adhesive 42 is Instant-Loc No. 346650 which can be commercially obtained from National Starch and Chemical Company in Cincinnati, Ohio. Preferably, a release agent such as Michem Release Coat No. 40 commercially available from Michelman, Inc. in Cincinnati, Ohio may also be applied.

Figure 4:
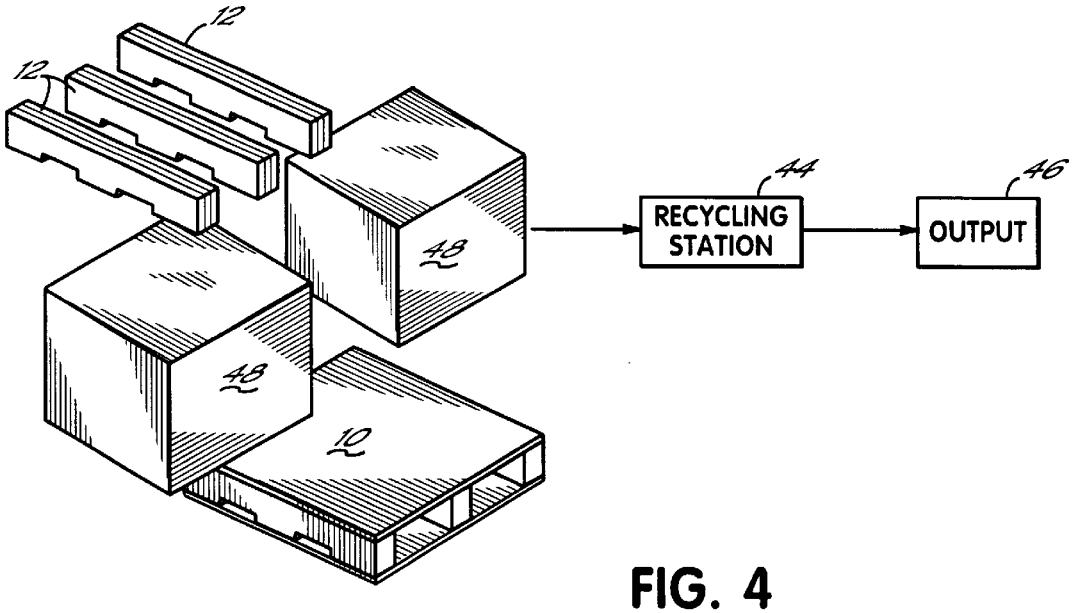
FIG. 4 is schematic representation of the pallet, runner and boxes or cartons being processed in a recycling station.

As shown in FIG. 4, the pallet 10 and/or runner 12, 12*a* can be processed in a paperboard recycling station 44 for output 46 along with standard paperboard boxes 48, containers or shipping materials.

From the above disclosure of the general principles of the present invention and the preceding detailed description of at least one preferred embodiment, those skilled in the art will readily comprehend the various modifications to which this invention is susceptible. For example and without limitation, the various features or aspects of the invention described herein may be utilized collectively, individually and/or in various combinations. Therefore, I desire to be limited only by the scope of the following claims and equivalents thereof.

I claim:

1. A pallet for supporting a load during transit and storage comprising:

a plurality of spaced, generally parallel runners, each of the runners comprising a plurality of layers of paperboard adhered together in a generally vertical orientation;

at least two spaced portals in each of the runners, the respective portals of each of the runners being aligned with one another so that tines of a lift truck can be inserted into the portals in a direction generally perpendicular to the runners for lifting the pallet and the load supported thereon, each of the portals being spaced from a bottom surface of the runner to inhibit the pallet and load from tipping off of the tines when inserted therein, the runners being spaced so that the tines can alternatively be inserted generally parallel to the runners for lifting the pallet and load;

a generally planar deck sheet joined to each of the runners; and a band in each of the runners to inhibit a rupture and indicate a failure of the runner under load by allowing the runner to deflect prior to failure;

wherein the band is adhered to one of the layers of the associated runner.

2. The pallet of claim 1 wherein each of the portals are spaced from a top surface of the runner.

3. The pallet of claim 1 wherein the band extends longitudinally in the runner and further comprises a plurality of strands.

4. The pallet of claim 3 wherein the strands are selected from the group consisting of nylon and polyester.

5. The pallet of claim 1 further comprising:

at least one generally vertically oriented reinforcing insert of a recyclable material Positioned interiorly of each runner between adjacent layers of the paperboard, wherein the reinforcing insert in each of the runners provides increased beam strength and resistance to compression of the runner and the layers of paperboard maintain the reinforcing insert in the generally vertical orientation during use and provide resistance to compression of the runner, each of the components of the pallet being entirely processible in a paperboard recycling system.

6. The pallet of claim 5 wherein the paperboard layers are corrugated paperboard with flutes of the corrugated paperboard being generally vertically aligned and perpendicular to the portals and the reinforcing insert is selected from the group consisting of hardboard, particleboard, chipboard, Kraft, fiberboard and liner board.

7. The pallet of claim 1 wherein the deck sheet is an upper deck sheet positioned between a top surface of the runners and the load, the pallet further comprising:

a generally planar lower deck sheet joined to a bottom surface of each of the runners.

8. A pallet for supporting a load during transit and storage comprising:

a plurality of spaced, generally parallel runners, each of the runners comprising a plurality of layers of corrugated paperboard adhered together with flutes of the layers of corrugated paperboard being generally aligned in a generally vertical direction;

at least one generally vertically oriented reinforcing insert positioned interiorly of the runner between adjacent layers of corrugated paperboard;

a band in each of the runners to inhibit a rupture and indicate a failure of the runner under load by allowing the runner to deflect prior to failure;

wherein the band is adhered to one of the layers and extends generally longitudinally in the associated runner;

at least two spaced portals in each of the runners, each of the portals being spaced from a bottom surface and a top surface of the runner to inhibit the pallet and load from tipping off of tines of a lift truck, the respective portals of each of the runners being aligned with one another so that the tines can be inserted into the portals in a direction generally perpendicular to the runners for lifting the pallet and the load supported thereon, the runners being spaced so that the tines can alternatively be inserted generally parallel to the runners for lifting the pallet and load;

a generally planar upper deck sheet joined to the top surface of each of the runners;

wherein the reinforcing insert in each of the runners provides increased beam strength and resistance to compression of the runner and the layers of corrugated paperboard maintain the reinforcing insert in the generally vertical orientation during use and provide resistance to compression of the runner, each of the components of the pallet being entirely processible in a paperboard recycling system.

9. The pallet of claim 8 wherein the band extends longitudinally in the runner and further comprises a plurality of strands.

10. The pallet of claim 9 wherein the strands are selected from the group consisting of nylon and polyester.

11. The pallet of claim 8 wherein the paperboard layers are corrugated paperboard with flutes of the corrugated paperboard being generally vertically aligned and perpendicular to the portals and the reinforcing insert is selected from the group consisting of hardboard, particleboard, chipboard, Kraft, fiberboard and liner board.

12. The pallet of claim 8 wherein the deck sheet is an upper deck sheet positioned between a top surface of the runners and the load, the pallet further comprising:

a generally planar lower deck sheet joined to a bottom surface of each of the runners.

13. A pallet for supporting a load during transit and storage comprising:

a plurality of spaced, generally parallel runners, each of the runners comprising a plurality of layers of paperboard adhered together in a generally vertical orientation;

a band in each of the runners to inhibit a rupture and indicate a failure of the runner under load by allowing the runner to deflect prior to failure;

wherein the band is adhered to one of the layers of the associated runner;

at least one generally vertically oriented reinforcing insert of a recyclable material positioned interiorly of each runner between adjacent layers of the paperboard, wherein the reinforcing insert in each of the runners provides increased beam strength and resistance to compression of the runner and the layers of paperboard maintain the reinforcing insert in the generally vertical orientation during use and provide resistance to compression of the runner, each of the components of the pallet being entirely processible in a paperboard recycling system; and a generally planar deck sheet joined to each of the runners.

14. A runner for supporting a load during transit and storage comprising:

a plurality of layers of paperboard adhered together in a generally vertical orientation;

at least two spaced portals in each of the runners, the respective portals of each of the runners being aligned with one another so that tines of a lift truck can be inserted into the portals in a direction generally perpendicular to the runners for lifting the load supported thereon, each of the portals being spaced from a bottom surface of the runner to inhibit the pallet and load from tipping off of the tines when inserted therein, the runners being spaced so that the tines can alternatively be inserted generally parallel to the runners for lifting the load;

a band in each of the runners to inhibit a rupture and indicate a failure of the runner under load by allowing the runner to deflect prior to failure;

wherein the band is adhered to one of the layers of the runner.

15. The runner of claim 14 wherein each of the portals are spaced from a top surface of the runner.

16. The runner of claim 14 wherein the band extends longitudinally in the runner and further comprises a plurality of strands.

17. The runner of claim 16 wherein the strands are selected from the group consisting of nylon and polyester.

18. The runner of claim 14 further comprising:

at least one generally vertically oriented reinforcing insert of a recyclable material positioned interiorly of each runner between adjacent layers of the paperboard, wherein the reinforcing insert in each of the runners provides increased beam strength and resistance to compression of the runner and the layers of paperboard maintain the reinforcing insert in the generally vertical orientation during use and provide resistance to compression of the runner, each of the components of the runner being entirely processible in a paperboard recycling system.

19. The runner of claim 18 wherein the paperboard layers are corrugated paperboard with flutes of the corrugated paperboard being generally vertically aligned and perpendicular to the portals and the reinforcing insert is selected from the group consisting of hardboard, particleboard, chipboard, Kraft, fiberboard and liner board.

20. A runner for supporting a load during transit and storage which is recyclable in a paperboard recycling system, the runner comprising:

a plurality of layers of corrugated paperboard adhered together with flutes of the layers of corrugated paperboard being generally aligned in a generally vertical direction;

at least one generally vertically oriented reinforcing insert positioned interiorly of the runner between adjacent layers of corrugated paperboard;

a band in each of the runners to inhibit a rupture and indicate a failure of the runner under load by allowing the runner to deflect prior to failure;

wherein the band is adhered to one of the layers of the runner, extends longitudinally in the runner and includes a plurality of strands; and at least two spaced portals in each of the runners, the respective portals of each of the runners being aligned with one another so that tines of a lift truck can be inserted into the portals in a direction generally perpendicular to the runners for lifting the runner and the load supported thereon, each of the portals being spaced from a bottom surface and a top surface of the runner to inhibit the runner and load from tipping off of the tines when inserted therein, the runners being spaced so that the tines can alternatively be inserted generally parallel to the runners for lifting the runner and load;

wherein the reinforcing insert in each of the runners provides increased beam strength and resistance to compression of the runner and the layers of corrugated paperboard maintain the reinforcing insert in the generally vertical orientation during use and provide resistance to compression of the runner, each of the components of the runner being entirely processible in a paperboard recycling system.

21. The runner of claim 20 wherein the strands are selected from the group consisting of nylon and polyester.

22. The runner of claim 20 wherein the paperboard layers are corrugated paperboard with flutes of the corrugated paperboard being generally vertically aligned and perpendicular to the portals and the reinforcing insert is selected from the group consisting of hardboard, particleboard, chipboard, Kraft, fiberboard and liner board.

23. The runner of claim 22 further comprising:

a deposit of adhesive applied to the top surface of the runner so that the runner can be selectively adhered to a bottom surface of the load in spaced generally parallel relation with similar runners for supporting the load during transit and storage.

24. A runner for supporting a load during transit and storage comprising:

a plurality of layers of paperboard adhered together in a generally vertical orientation;

a band in each of the runners to inhibit a rupture and indicate a failure of the runner under load by allowing the runner to deflect prior to failure;

wherein the band is adhered to one of the layers of the runner and extends generally longitudinally in the runner; and at least one generally vertically oriented reinforcing insert of a recyclable material positioned interiorly of each runner between adjacent layers of the paperboard, wherein the reinforcing insert in each of the runners provides increased beam strength and resistance to compression of the runner and the layers of paperboard maintain the reinforcing insert in the generally vertical orientation during use and provide resistance to compression of the runner, each of the components of the pallet being entirely processible in a paperboard recycling system.

25. A pallet for supporting a load during transit and storage comprising:

a plurality of spaced, generally parallel runners, each of the runners comprising a plurality of layers of paperboard adhered together in a generally vertical orientation;

a generally planar deck sheet joined to each of the runners; and a band in each of the runners to inhibit a rupture and indicate a failure of the runner under load by allowing the runner to deflect prior to failure;

wherein the band is adhered to one of the layers of the associated runner.

26. A runner for supporting a load during transit and storage comprising:

a plurality of layers of paperboard adhered together in a generally vertical orientation;

a band in each of the runners to inhibit a rupture and indicate a failure of the runner under load by allowing the runner to deflect prior to failure;

wherein the band is adhered to one of the layers of the runner.

27. The runner of claim 26 wherein the band extends generally longitudinally in the runner.

28. The pallet of claim 25 wherein the band extends generally longitudinally in the associated runner.

29. The pallet of claim 13 wherein the band extends generally longitudinally in the runner.

* * * * *

UNITED STATES PATENT AND TRADEMARK OFFICE

CERTIFICATE OF CORRECTION

PATENT NO. : 6,453,827 B1
DATED : September 24, 2002
INVENTOR(S) : John R. Perazzo It is certified that error appears in the above-identified patent and that said Letters Patent is hereby corrected as shown below:

Column 8,
Line 57, “pallet” should read -- pallet 10 --.

Column 13,
Line 25, “material Positioned,” should read -- material positioned --.

Column 16,
Line 11, “claim 22” should read -- claim 20 --.

Signed and Sealed this

Eighth Day of April, 2003

JAMES E. ROGAN
*Director of the United States Patent and Trademark Office*